US009302168B2

(12) United States Patent
Williams

(10) Patent No.: US 9,302,168 B2
(45) Date of Patent: Apr. 5, 2016

(54) GOLF STROKE TRAINING DEVICE

(71) Applicant: Livingston Williams, Weatouge, CT (US)

(72) Inventor: Livingston Williams, Weatouge, CT (US)

( * ) Notice: Subject to any disclaimer, the term of this patent is extended or adjusted under 35 U.S.C. 154(b) by 0 days.

(21) Appl. No.: 14/537,895

(22) Filed: Nov. 10, 2014

(65) Prior Publication Data

US 2015/0165298 A1 Jun. 18, 2015

Related U.S. Application Data

(60) Provisional application No. 61/901,706, filed on Nov. 8, 2013.

(51) Int. Cl.
*A63B 69/36* (2006.01)

(52) U.S. Cl.
CPC ..... *A63B 69/3644* (2013.01); *A63B 69/3623* (2013.01); *A63B 69/3667* (2013.01); *A63B 69/3676* (2013.01); *A63B 2225/09* (2013.01)

(58) Field of Classification Search
USPC ..... 473/216, 227, 257, 258, 264, 269, 272, 473/277
See application file for complete search history.

(56) References Cited

U.S. PATENT DOCUMENTS

| | | | | |
|---|---|---|---|---|
| 3,730,531 | A | 5/1973 | Zega | |
| 4,593,909 | A | 6/1986 | Anselmo | |
| 5,072,942 | A | 12/1991 | Hurley | |
| 5,330,192 | A | 7/1994 | Amos | |
| 6,497,627 | B2 * | 12/2002 | Collins | 473/264 |
| 6,575,844 | B1 * | 6/2003 | Gray | 473/277 |
| 6,843,730 | B1 * | 1/2005 | Bellagamba | 473/216 |
| 6,949,030 | B1 | 9/2005 | Gauer | |
| 7,217,198 | B2 | 5/2007 | Brooks | |
| 7,758,441 | B2 * | 7/2010 | Rochford et al. | 473/257 |
| 2011/0070967 | A1 * | 3/2011 | Davis, Jr. | 473/282 |
| 2012/0264533 | A1 * | 10/2012 | Sasser | 473/208 |

* cited by examiner

*Primary Examiner* — Nini Legesse
(74) *Attorney, Agent, or Firm* — Daniel Boudwin, Esq.; Global Intellectual Property Agency, LLC

(57) ABSTRACT

A golf stroke training device adapted to assist users in practicing the mechanics of different types of golf strokes. The device comprises a plurality of adjustable markers that provide both a physical and visual cue to the user if the user's backswing is too long for the type of stroke that he or she is practicing. The device can be configured for a variety of different types of golf strokes, including putts, pitches, chips, and drives. The device is highly adjustable and suitable for use by many differently sized individuals. The device comprises a frame having a base and an upper portion, a front and back post extending from the upper portion at an angle, and a plurality of markers adjustably attached to the frame. The markers comprise backswing markers that indicate where a particular swing type should end and feet markers that show where the user should stand.

19 Claims, 5 Drawing Sheets

GOLF STROKE TRAINING DEVICE

CROSS REFERENCE TO RELATED APPLICATION

This application claims the benefit of U.S. Provisional Application No. 61/901,706 filed on Nov. 8, 2013. The above identified patent application is herein incorporated by reference in its entirety to provide continuity of disclosure.

BACKGROUND OF THE INVENTION

1. Field of the Invention

The present invention relates to a golf stroke training device. More specifically, the present invention relates to a golf stroke training device that is adapted to train the mechanics for a variety of different golf strokes, including full swings or drives, pitches, chips, and putts.

2. Description of the Prior Art

Devices have been disclosed in the prior art that relate to golf stroke training devices. These include devices that have been patented and published in patent application publications. These devices generally relate to devices that guide or physically restrict the movement of the user or the user's golf club. The following is a list of devices deemed most relevant to the present disclosure, which are herein described for the purposes of highlighting and differentiating the unique aspects of the present invention, and further highlighting the drawbacks existing in the prior art.

Many golf swing training devices function by physically restricting the movement of the user or the user's golf club, thereby attempting to force the user into correct form. However, these devices can be very uncomfortable, which negatively impacts the enjoyment of using the device. Furthermore, when a user is forced into correct form, he or she may not develop proper muscle memory because the movement is unnatural and so far divorced from on-course conditions. Other types of devices are only adapted to assist users in practicing a single type of stroke, e.g. a full swing or a putt. Therefore, there is a need in the prior art for a device which is readily adaptable to assist users in practicing a variety of different swings and that also allows users to develop the appropriate muscle memory and therefore replicate the swing accurately during on-course conditions.

It substantially diverges in design elements from the prior art and consequently it is clear that there is a need in the art for an improvement to existing golf stroke training devices. In this regard the instant invention substantially fulfills these needs.

SUMMARY OF THE INVENTION

In view of the foregoing disadvantages inherent in the known types of golf swing training devices now present in the prior art, the present invention provides a new golf swing training device wherein the same can be utilized for providing convenience for the user for training all types of golf strokes, including full swings, pitches, chips, and putts.

It is therefore an object of the present invention to provide a new and improved golf stroke training device that has all of the advantages of the prior art and none of the disadvantages.

It is another object of the present invention to provide a golf stroke training device that is not limited to training the mechanics of a single type of golf stroke.

Another object of the present invention is to provide a golf stroke training device that is adaptable for a large size range of individuals.

Yet another object of the present invention is to provide a golf stroke training device that teaches individuals proper stroke mechanics via projections that provide physical cues to the user of where to begin his or her swing and when to alter his or her swing path.

Still yet another object of the present invention is to provide a golf stroke training device that comprises a golf club holder for teaching golfers to develop a sturdy putting grip.

Yet another object of the present invention is to provide a golf stroke training device that teaches users the four essential swing positions.

Still yet another object of the present invention is to provide a golf stroke training device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
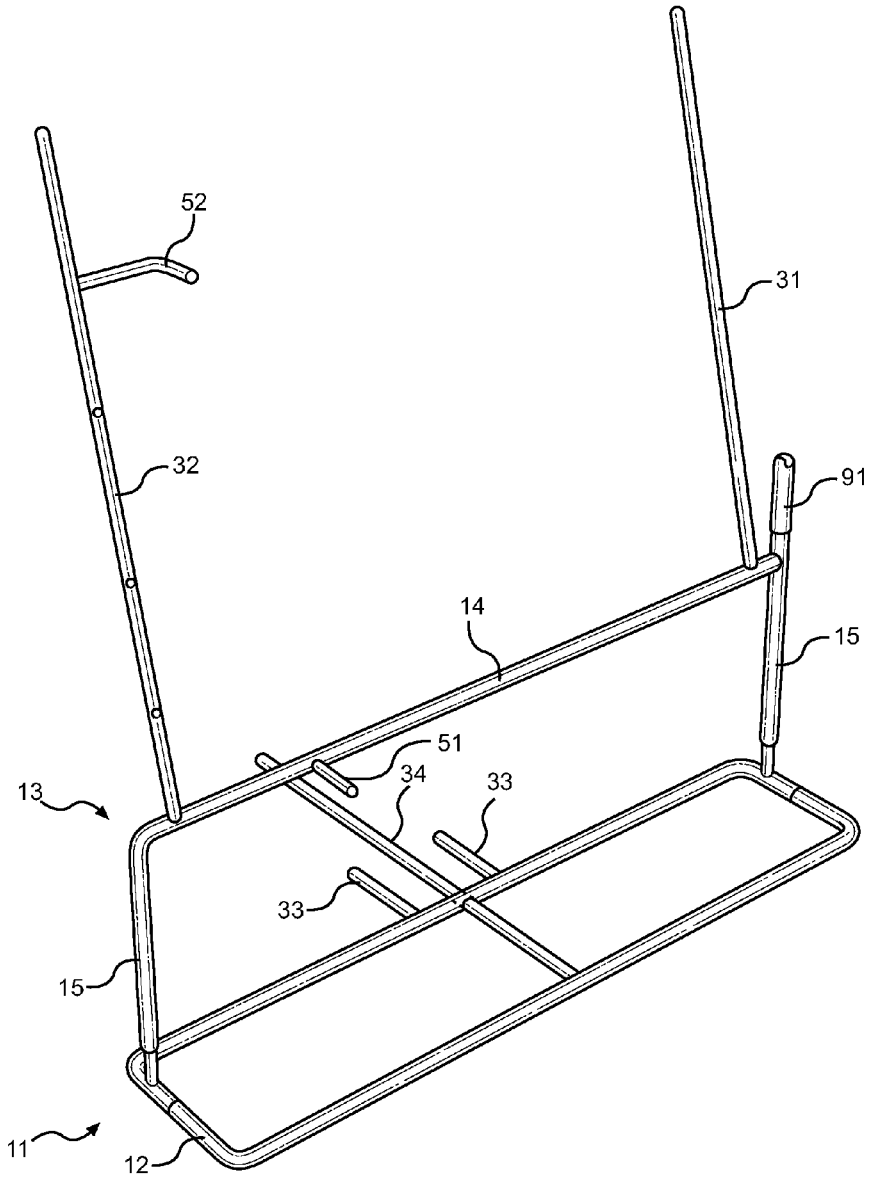
FIG. 1 shows a perspective view of the present invention.

Reference is made herein to the attached drawings. Like reference numerals are used throughout the drawings to depict like or similar elements of the golf stroke training device. For the purposes of presenting a brief and clear description of the present invention, the preferred embodiment will be discussed as used by a right-handed individual training his or her golf stroke. The figures are intended for representative purposes only and should not be considered to be limiting in any respect.

The present invention is a highly adjustable device adapted to assist all types of individuals with all different types of golf strokes, including drives, chips, pitches, putts, and the like. The present invention functions by providing individuals with physical and visual cues or indicators as to where to place their feet, how far to stand away from the ball, and when to halt their backswing for different types of golf strokes. The locations of the various indicators can be adjusted to provide individuals with the ability to train different types of golf strokes. For example, when training a chip stroke, users can place a backswing marker at a low portion on the back post in order to limit the backward movement of the golf club and thereby indicate to themselves to shorten up their stroke and make other such alterations to their swing, as compared to a full swing. If individuals' swings extend too far back for the type of stroke being trained, the club will make contact with the indicator and the individuals will thereby know to take corrective action on the subsequent swings, i.e. shorten their strokes. Through repeated swinging, the proper stroke mechanics will be ingrained into the individuals' muscle memory.

Figure 2:
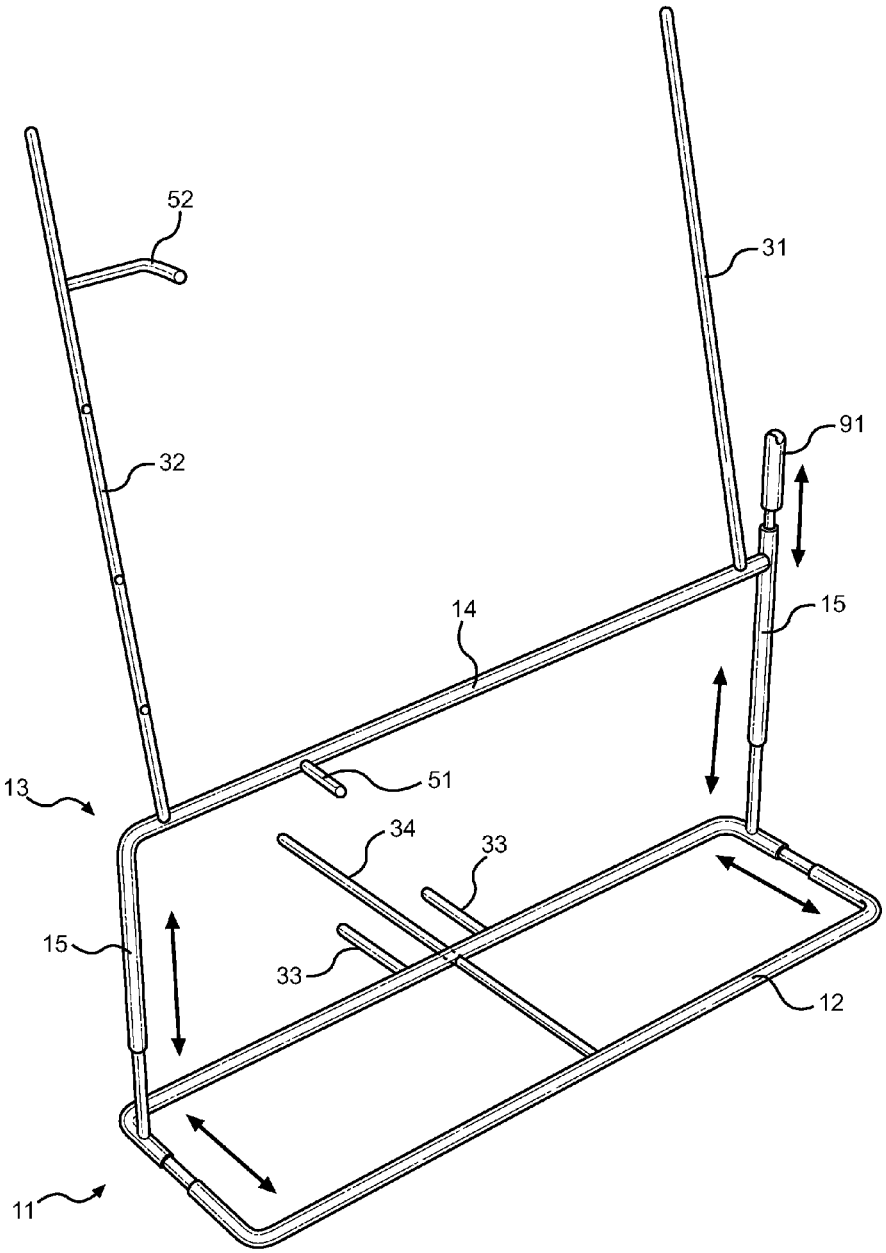
FIG. 2 shows a perspective view of the present invention, including the adjustability of the base and the upper portion.

Referring now to FIGS. 1 and 2, there are shown perspective views of the present invention. The present invention comprises a frame 11 having a base 12 and an upper portion 13. The base 12 rests flat against the ground and provides a wide support to balance the weight of the upper portion 13 and the other components of the present invention, preventing it from tipping over or otherwise shifting when in use. As depicted, the base 12 comprises a series of members connected in a rectangular arrangement; however, the present disclosure contemplates a base 12 having any type of shape. The upper portion 13 comprises a pair of upstanding members 15 extending perpendicularly from the base 12 and a horizontal member 14 extending therebetween. The horizontal member 14 is preferably disposed parallel to the ground on which the frame 11 is resting, thereby allowing the various markers disposed thereon to be properly aligned with an individual addressing the ball. The frame 11 may be constructed from PVC or other such durable materials. The height of the upper portion 13 and the width of the base 12 are both adjustable by any means known in the prior art. In the depicted embodiment of the present invention, the upper portion 13 and the base 12 each comprise complementary portions that are slidably connected together, thereby allowing the complementary portions to be slid up or out from each other. The present invention may further comprise a locking mechanism to hold the extended complementary portions in place to ensure that they do not shift during use.

The present invention further comprises a variety of different indicators extending from various positions on the frame 11. The indicators provide a visual cue to users as to where to place their feet and when to halt one's backswing. The indicators comprise a pair of feet markers 33 extending from the base 12, a centerline marker 34 disposed therebetween, a front post 31 extending from the horizontal member 14 of the upper portion 13, a back post 32 extending from the horizontal member 14 of the upper portion 13, and one or more backswing markers 51, 52.

The centerline indicator 34 corresponds to the position that the user should stand such that the centerline indicator 34 bisects his or her body. The feet markers 33 are disposed at the position corresponding to the medial aspect of the user's feet. The combination of the centerline indicator 34 and the feet markers 33 thereby provides individuals with a means to determine where to properly position themselves when addressing a golf ball. In the depicted embodiment of the present invention, the centerline marker 34 is fixed in place and the base 12 is slidably disposed therealong. The feet markers 33 are adjustably attached to the base 12, allowing the users to alter the positions of the feet markers 33 depending upon their size, the stance that is comfortable for them, and other such factors.

The first backswing marker 51 and the second backswing marker 52 are adapted to provide physical and visual cues as to where the apex of the user's backswing for the particular type of stroke should be located. In the depicted embodiment of the present invention, the first backswing marker 51 comprises an elongated, straight member and the second backswing marker 52 comprises an L-shaped member. The first and second backswing markers 51, 52 are adjustably positionable on the back post 32 and the upper portion 13 of the present invention. The first backswing marker 51 is adapted to be positioned anywhere along the length of the back post 32 or upper portion 13 because it is intended for use when practicing the swing of any type of stroke, except for when practicing a full swing, i.e. a drive. The L-shaped second backswing marker 52 is adapted to be positioned at the distal end of the back post 32 because it is intended to be used when practicing a full swing.

The present invention further comprises a club holder 91 extending from the horizontal member 14 of the frame 11. The club holder 91 comprises a clip disposed at the distal end thereof that is adapted to receive the shaft of a golf club therein and hold the golf club securely in place. With the golf club held in place and the handle of the golf club presented before the user, the user can then practice his or her grip on the golf club in a convenient manner. The golf club holder 91 is slidably disposed on the upper portion 13, allowing the height of the club holder 91 to be independently adjusted relative to the upper portion 13 of the frame 11.

Figure 3:
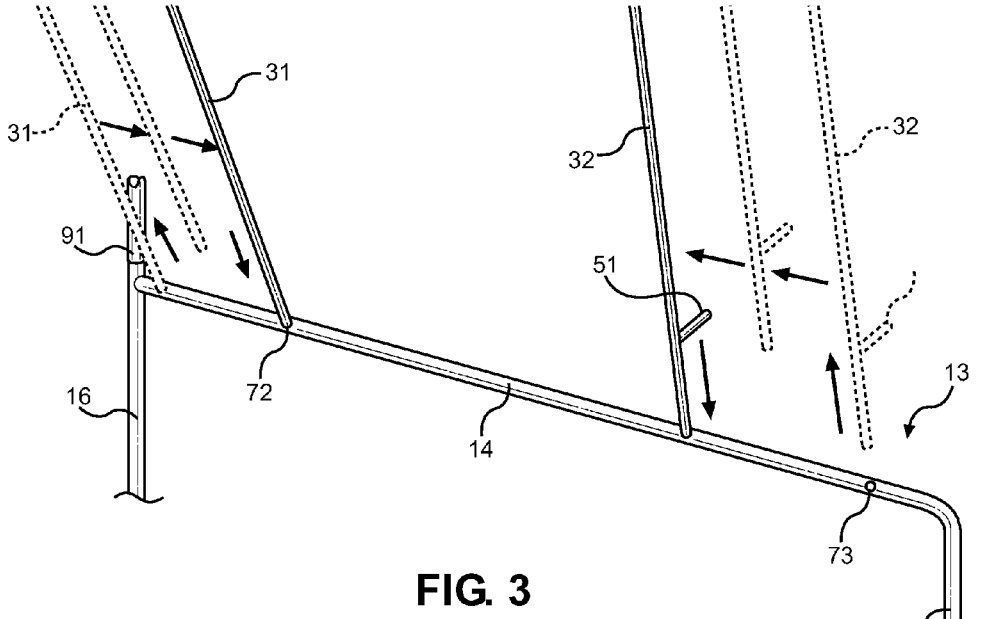
FIG. 3 shows a view of the adjustable connection of the feet markers.
Figure 4:
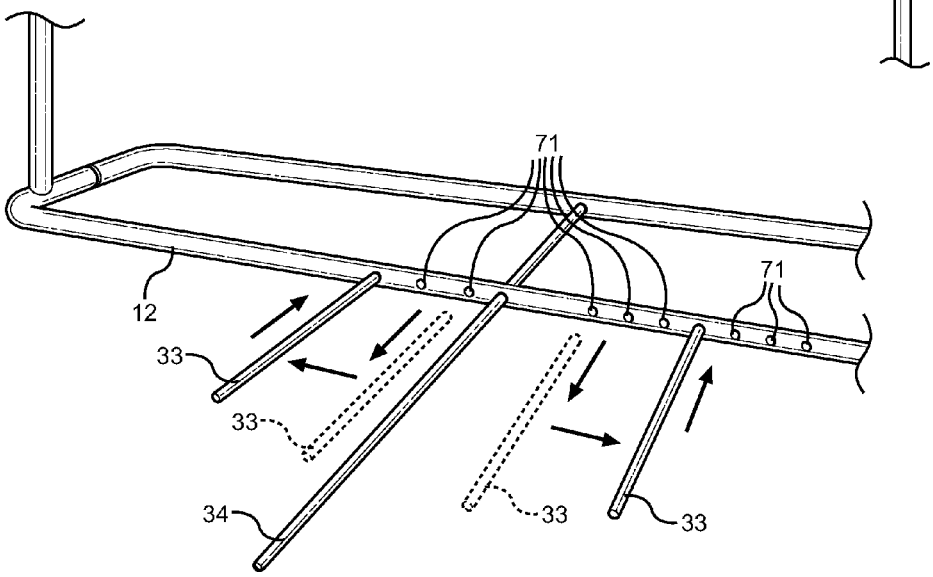
FIG. 4 shows a view of the adjustable connections of the front post and the back post.
Figure 5:
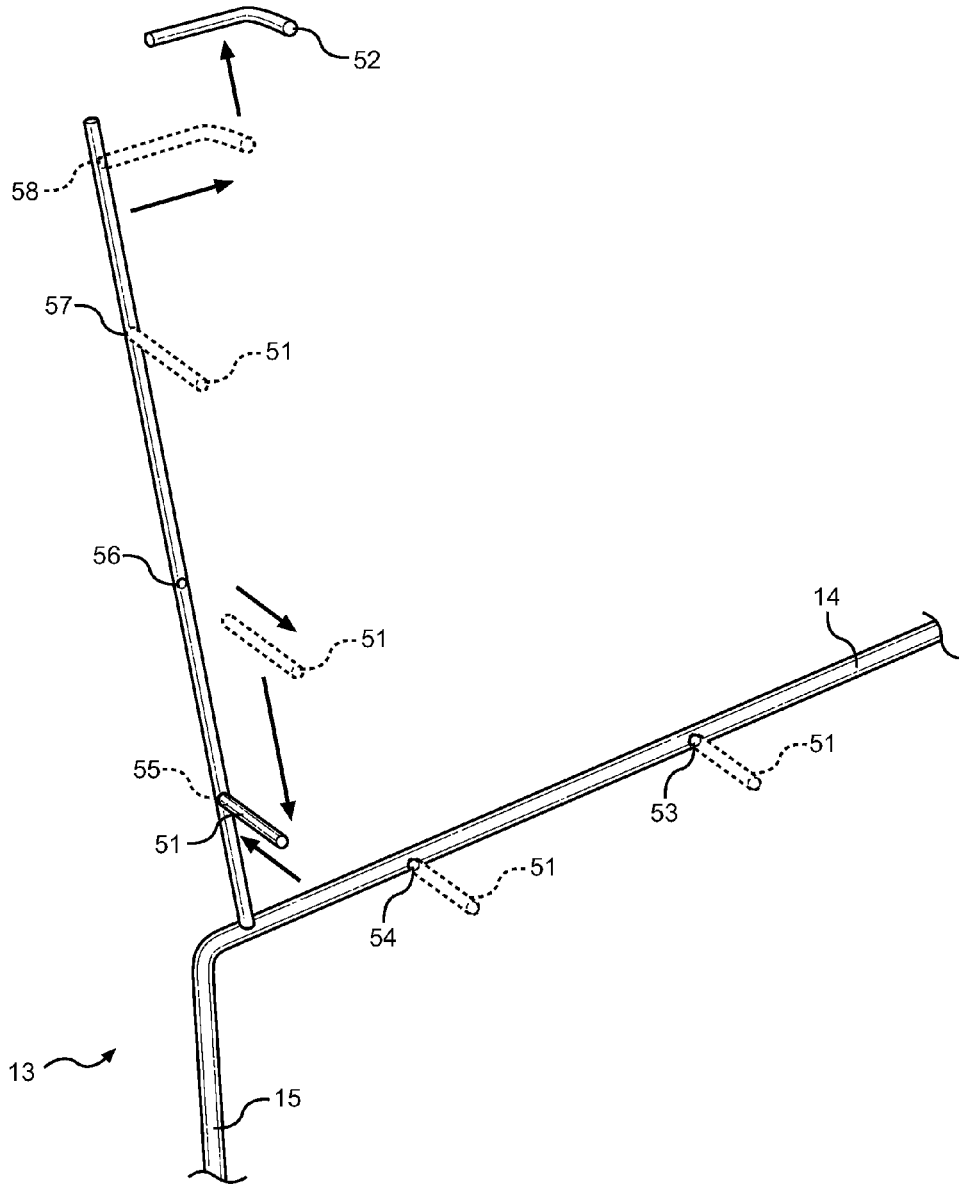
FIG. 5 shows a view of the adjustable connections of the backswing markers.

Referring now to FIGS. 3-5, there are shown views of the various adjustable connections of various components of the present invention. The front post 31, back post 32, feet markers 33, and the backswing markers 51, 52 are all independently adjustable. Each of these components can be placed at different positions in order to alter the functionality of the present invention. The position of the feet markers 33 can be changed so that the present invention can accommodate differently sized individuals or individuals seeking to practice different types of stances. The positions of the front and back posts 31, 32 can also be adjusted depending upon the size of the user. Users having longer arms can place the front and back posts 31, 32 at the more distal positions on the horizontal member 14 of the frame 11, whereas users with shorter arms can place the front and back posts 31, 32 at more proximal positions on the horizontal member 14.

In the depicted embodiment of the present invention, the adjustability of the various posts 31, 32 and markers 33, 51, 52 is provided by a plurality of recesses that are adapted to receive one of the ends of the posts 31, 32 or the markers 33, 51, 52 therein. The shape and diameter of the recesses is substantially equal to the shape and diameter of the post 31, 32 or marker 33, 51, 52 to be placed therein, thereby providing fitment between the components and allowing the post 31, 32 or marker 33, 51, 52 to be securely, yet removably, held in place. The front and back posts 31, 32 are adapted to engage with a corresponding set of front and back post recesses 72, 73 disposed along the top edge of the horizontal member 14. Likewise, the feet markers 33 are adapted to engage with a corresponding set of feet marker recesses 71 disposed along the lateral edge of the base 12, corresponding to the position at wish the user is to stand.

The first and second backswing markers 51, 52 are also adapted to engage with corresponding recesses disposed along the horizontal member 14 and the back post 32. Each of the discrete positions of the backswing marker recesses corresponds to a different type of stroke for the user to train. The backswing markers comprise a first position 53 corresponding a putt swing, a second position 54 corresponding to a one-half chip swing, a third position 55 corresponding to a full chip swing, a fourth position 56 corresponding to a one-half swing, a fifth position 57 corresponding to a three-quarters swing, and a sixth position 58 corresponding to a full swing. In the depicted embodiment of the present invention, the recess corresponding to the first position 53 is disposed on the lateral surface of the horizontal member opposite of the user's position such that the first backswing marker 51, when placed therein, extends perpendicularly therefrom relative to the vertical axis of the frame 11. The recesses corresponding to the remaining positions 54-58 are disposed on the back post 32. However, the depicted embodiment is merely exemplary and the present invention comprises any number of discrete positions for the backswing markers, which allows for all different types of strokes to be trained. As such, no specific claim is made as to the number or distribution of the recesses adapted to engage with the backswing markers 51, 52. Furthermore, the sixth position 56 is rotated ninety degrees on the back post 32 relative to the recesses of the prior positions in order to ensure that the projecting portion of the second backswing marker 52 projects therefrom along the same path as the first backswing marker 51 placed within the lower positions.

The present invention comprises any other type of mechanism for the posts 31, 32 and markers 33, 51, 52 that allows for the position of the components to be adjusted, such as an adhesive connection between the components and the frame 11, a threaded end for the components that engages with a complementary portion, and other such removable connections known in the prior art. In an alternative embodiment of the present invention, the posts 31, 32 and markers 33, 51, 52 are integral to the frame 11 and back post 32, but are slidably disposed therealong so that their position can be adjusted as desired by the user. This alternative embodiment of the present invention may comprise a locking mechanism for holding the posts 31, 32 and markers 33, 51, 52 in place at the desired location to ensure that they do not shift while the present invention is in use.

Figure 6:
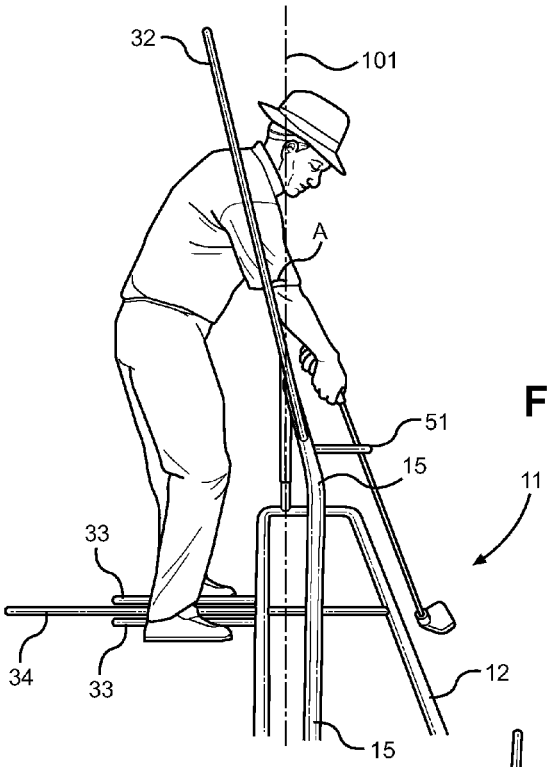
FIG. 6 shows a side view of the present invention in use with the user's arms aligned with the back post.

Referring now to FIG. 6, there is shown a side view of the present invention in use with the user's arms aligned with the back post. The back post 32 and the front post (not shown) extending the horizontal member 14 at a thirty-five degree angle A relative to the vertical axis 101 of the frame 11. Users can place their arms so that they are roughly aligned with the posts 31, 32, which places their arms in the correct position for their swing.

Figure 7:
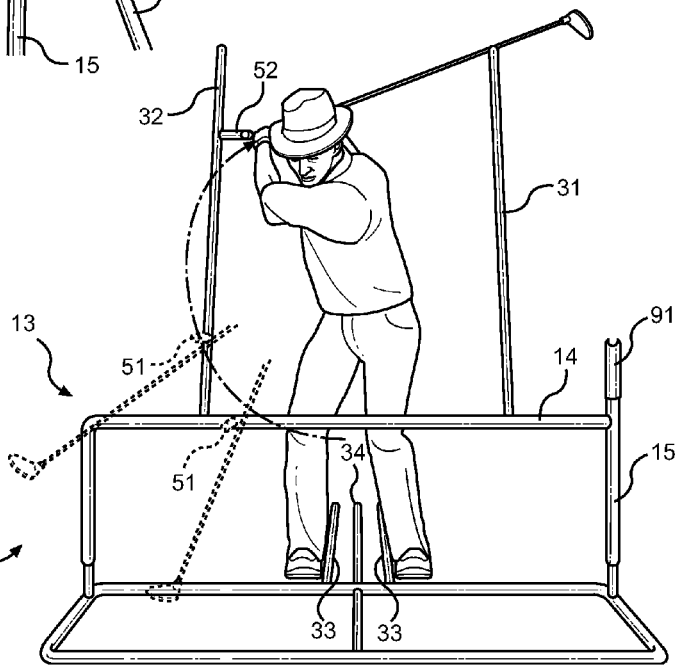
FIG. 7 shows a front view of the present invention in use.

Referring now to FIG. 7, there is shown a front view of the present invention in use. Individuals make use of the present invention by first choosing the type of stroke that they wish to practice and then placing either the first and second backswing marker 51, 52 in the position corresponding to that stroke. Users then place the feet markers 33 in a position corresponding to approximately shoulder width apart and then place their feet such that the medial aspect of their feet is flush against the feet markers 33. Users then grip a club and then extend their arms over the horizontal member 14 of the frame 11, keeping their arms aligned with the front and back posts 31, 32. Users are thereafter in a proper position to take practice swings.

The disclosed embodiment of the present invention was intended for use by a right-handed individual; however, in alternative embodiments both the front and back posts 31, 32 may have slots for receiving the backswing markers 51, 52 therein. This alternative embodiment of the present invention is therefore suited for use by both right and left-handed individuals. For this embodiment of the present invention, left-handed individuals can simply flip the orientation of their body and place the backswing markers 51, 52 in corresponding slots on the front post 31, rather than the back post 32 that is used by right-handed individuals.

If the user's club or hands make contact with the backswing markers 51, 52, then the user knows that his or her swing is too long for that type of stroke and therefore he or she needs to shorten his or her swing. In the depicted embodiment of the present invention, the first backswing marker 51 is used when practicing all of the strokes except for a full swing, including a putt, half chip, full chip, half swing, and three-quarters swing. The second backswing marker 52 is specifically designed to be used when practicing a full swing. The second backswing marker 52 is L-shaped because it needs to be offset relative to the other positions disposed on the back post 32 in order to account for the arc of the user's swing. If the second backswing marker 52 was not offset to a more medial position relative to the user, then the user would not be able to practice a full swing because the position of the second backswing marker 52 would block the user from completing his or her full arc.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf stroke training device, comprising:

a frame comprising a base and an upper portion extending vertically from said base;

a plurality of feet markers extending from said base, said plurality of feet markers disposed in a parallel arrangement;

a front post attached to said upper portion;

a back post attached to said upper portion;

one or more backswing markers attachable to said upper portion and said back post, the one or more backswing markers comprising a first backswing marker and an L-shaped second backswing marker.

2. The golf stroke training device of claim 1, wherein said upper portion is height adjustable.

3. The golf stroke training device of claim 1, wherein said base is width adjustable.

4. The golf stroke training device of claim 1, further comprising a centerline marker extending between said feet markers.

5. The golf stroke training device of claim 1, further comprising a club holder, said club holder comprising a clip adapted to removably secure a shaft portion of a golf club.

6. The golf stroke training device of claim 5, wherein said club holder is height-adjustably attached to said upper portion.

7. The golf stroke training device of claim 1, wherein said feet markers comprise an adjustable connection to said base.

8. The golf stroke training device of claim 7, wherein said adjustable connection comprises a plurality of recesses disposed on said base that are adapted to receive said feet markers therein.

9. The golf stroke training device of claim 1, wherein said front post comprises an adjustable connection to said upper portion.

10. The golf stroke training device of claim 9, wherein said adjustable connection comprises a plurality of recesses disposed on said upper portion that are adapted to receive said front post therein.

11. The golf stroke training device of claim 9, wherein said adjustable connection comprises a plurality of recesses disposed on said upper portion that are adapted to receive said back post therein.

12. The golf stroke training device of claim 1, wherein said back post comprises an adjustable connection to said upper portion.

13. The golf stroke training device of claim 1, wherein said one or more backswing markers comprise an adjustable connection to said golf stroke training device.

14. The golf stroke training device of claim 13, wherein said adjustable connection comprises a plurality of recesses disposed on said back post and said upper portion that are adapted to receive said one or more backswing markers therein.

15. The golf stroke training device of claim 14, wherein said plurality of recesses comprises a first position corresponding to a putt swing, a second position corresponding to a half chip swing, a third position corresponding to a full chip swing, a fourth position corresponding to a half swing, a fifth position corresponding to a three-quarters swing, and a sixth position corresponding to a full swing.

16. The golf stroke training device of claim 13, wherein said adjustable connection comprises a plurality of recesses disposed on said back post, said front post, and said upper portion that are adapted to receive said one or more backswing markers therein.

17. The golf stroke training device of claim 16, wherein said device is usable by both right and left-handed users.

18. The golf stroke training device of claim 1, wherein said back post is disposed at a 35-degree angle relative to a vertical axis of said frame.

19. The golf stroke training device of claim 1, wherein:

said adjustable connection comprises a plurality of recesses disposed on said back post and said upper portion that are adapted to receive said one or more backswing markers therein;

said plurality of recesses comprises a first position corresponding to a putt swing, a second position corresponding to a half chip swing, a third position corresponding to a full chip swing, a fourth position corresponding to a half swing, a fifth position corresponding to a three-quarters swing, and a sixth position corresponding to a full swing;

said first position, second position, third position, fourth position, and fifth position adapted to receive said first backswing marker;

said sixth position adapted to receive said second backswing marker.

* * * * *